US006855241B2

(12) United States Patent
Palmer

(10) Patent No.: US 6,855,241 B2
(45) Date of Patent: Feb. 15, 2005

(54) PROCESS AND APPARATUS FOR SMELTING ALUMINUM

(76) Inventor: Forrest M. Palmer, 31 Towhee Rd., Hilton Head, SC (US) 29926

( * ) Notice: Subject to any disclaimer, the term of this patent is extended or adjusted under 35 U.S.C. 154(b) by 86 days.

(21) Appl. No.: 10/127,980

(22) Filed: Apr. 22, 2002

(65) Prior Publication Data

US 2003/0196911 A1 Oct. 23, 2003

(51) Int. Cl.[7] ..... C25C 3/06
(52) U.S. Cl. ..... 205/392; 205/372
(58) Field of Search ..... 205/372, 376, 205/389, 392, 393

(56) References Cited

U.S. PATENT DOCUMENTS

| | | | | |
|---|---|---|---|---|
| 2,451,490 A | * | 10/1948 | Johnson | 205/347 |
| 2,974,032 A | | 3/1961 | Grunert et al. | 75/10 |
| 3,501,387 A | | 3/1970 | Love | 204/67 |
| 3,616,439 A | | 10/1971 | Love | 204/244 |
| 3,661,561 A | | 5/1972 | Frey, Jr. et al. | 75/68 R |
| 3,661,562 A | | 5/1972 | Seth et al. | 75/68 R |
| 3,674,674 A | | 7/1972 | Arts et al. | 204/225 |
| 3,804,968 A | * | 4/1974 | Mosser | 373/152 |
| 4,099,959 A | | 7/1978 | Dewing et al. | 75/10 R |
| 4,173,518 A | | 11/1979 | Yamada et al. | 204/67 |
| 4,181,584 A | | 1/1980 | Steiger et al. | 204/67 |
| 4,269,673 A | | 5/1981 | Clark | 204/67 |
| 4,324,585 A | | 4/1982 | Hass | 75/68 B |
| 4,338,177 A | | 7/1982 | Withers et al. | 204/243 R |
| 4,451,337 A | | 5/1984 | Frilund et al. | 204/67 |
| 4,592,812 A | | 6/1986 | Beck et al. | 204/67 |
| 4,608,134 A | | 8/1986 | Brown | 204/67 |
| 4,608,135 A | | 8/1986 | Brown | 204/67 |
| 4,650,552 A | | 3/1987 | de Nora et al. | 204/67 |
| 4,681,671 A | | 7/1987 | Duruz | 204/67 |
| 4,749,463 A | | 6/1988 | Holmen | 204/241 |
| 4,865,701 A | | 9/1989 | Beck et al. | 204/67 |
| 5,006,209 A | | 4/1991 | Beck et al. | 204/67 |
| 5,336,378 A | | 8/1994 | Nishimura et al. | 204/64 T |
| 5,368,702 A | | 11/1994 | de Nora | 204/67 |
| 5,409,580 A | | 4/1995 | Gesing et al. | 204/67 |
| 5,505,823 A | | 4/1996 | Rendall | 205/354 |
| 5,643,426 A | | 7/1997 | Imoto et al. | 204/294 |
| 5,938,914 A | | 8/1999 | Dawless et al. | 205/301 |
| 6,251,237 B1 | | 6/2001 | Bos et al. | 204/241 |

OTHER PUBLICATIONS

Haupin, Warren. "Reflections of the Hall–Heroult Process." *Ecole Polytechnique Universitaire de Marseille*. Jan. 10, 2002 <iusti.univ–mrs.fr./MOLTEN_Salts/IUSTI_EDITION/59/edito_59.html>.

(List continued on next page.)

*Primary Examiner*—Roy King
*Assistant Examiner*—Harry D Wilkins, III
(74) *Attorney, Agent, or Firm*—Nelson Mullins Riley & Scarborough, LLP

(57) ABSTRACT

An apparatus for the smelting of aluminum includes a melting furnace that is separate from and free of permanent interconnection with an electrolytic cell. The melting furnace is preferably an induction melting furnace that is designed for optimum heating and intermixing of a cryolite electrolyte and alumina, and the electrolytic cell is preferably designed for electrolysis of alumina without regard for heating, mixing or dissolving requirements. Methods for operating the apparatus are also described.

6 Claims, 6 Drawing Sheets

OTHER PUBLICATIONS

Spain, Kevin. "Induction Heating Offers Many Processing Opportunities." *Industrial Heating*. Jun. 7, 2001. Feb. 19, 2002 <http://www.industrialheating.com/CDA/Article Information/features/.../0,2832,27826,00.htm>.

"Aluminum Direct Electric Heat Melting Furnace." *Modern Casting*. Accessed Feb. 19, 2002 <http://www.moderncasting.com/archive/ProductInnos/Prod_057_01.asp>.

"Aluminum Industry." *Greenhouse Gas Pollution Prevention Project; Climate Change Supplement*. Accessed Jan. 10, 2002 <www.climatechangeindia.com/climatechange/aluminum.htm>.

"New Materials Improve Energy Efficiency and Reduce Electricity Use in Aluminum Production." 1992. *EnviroSense*. Prepared for U.S. Department of Energy. Produced by National Renewable Energy Laboratory. Accessed Jan. 10, 2002 <es.epa.gov/techinfo/facts/nu–matrl.html>.

"Technical Information." and "Products." *Inductotherm (India) Ltd.*). Accessed Mar. 20, 2002 <http://www.inductothermindia.com>.

* cited by examiner

PROCESS AND APPARATUS FOR SMELTING ALUMINUM

BACKGROUND OF THE INVENTION (1) Field of the Invention

The present invention relates to an apparatus and process for the production of aluminum by electrolysis, and more particularly to an apparatus for aluminum smelting having separate sections for alumina dissolution and for electrolysis.

(2) Description of the Related Art

Aluminum is produced from bauxite, a mineral that contains various oxides and hydroxides of aluminum. In the most prominent commercial process, the aluminum values are extracted from bauxite ore by the Bayer process to produce alumina ($Al_2O_3$). Alumina is then processed to aluminum metal in the Hall-Héroult electrolytic process. About four tons of bauxite yield about two tons of alumina, which, in turn, yields about one ton of aluminum metal.

The Hall-Héroult process is an electrolytic process that uses electrical energy to split the aluminum and oxygen in aluminum oxide (alumina). In a typical Hall-Héroult electrolytic cell, an anode (positive electrode) made of carbon descends from the top of the cell, and a cathode (negative electrode) also currently made of carbon, forms the bottom of the cell. Both electrodes are submerged in a bath of molten cryolite electrolyte (sodium aluminum fluoride with added fluorides of calcium, aluminum, lithium and magnesium) at a temperature of about 960° C. Alumina has a limited solubility in molten cryolite, and most cells operate with 1.5–6% by weight aluminum oxide in the electrolyte. The carbon anodes are consumed during electrolysis and must be lowered during service to maintain a constant electrolyte gap of about 2–3 inches between the anode and the cathode. When the anodes are eroded to a certain degree, often after a period of only two or three weeks, the cell must be shut down for replacement of the anodes.

In the electrolytic process, aluminum metal is freed at the cathode and oxygen collects at the anode and reacts with the carbon of the anode to form carbon dioxide, which is vented from the cell. Aluminum metal forms a pool on top of the cathode and periodically is drained from the cell. As the concentration of alumina in the molten cryolite is depleted, it can be replenished by adding fresh alumina into the top of the cell.

The electrolysis process consumes large amounts of electricity, and about 15,000 to 16,000 kWh of electrical energy are required per ton of aluminum. Most of this energy is consumed in the electrolysis process, with much lower amounts used for the production of alumina. However, it is believed that most (up to 60%) of the electrical energy used during electrolysis goes toward the heating and melting of cryolite and the dissolution of alumina, rather than to the electrolytic splitting of aluminum and oxygen. Despite a great deal of research and development over the past 100 years, the Hall-Héroult production process, and the equipment used in that process commercially, has remained basically the same, and energy use efficiencies have not been improved by a great deal. See, e.g., Anonymous, *Aluminum Industry*, http://www.climatechangeindia.com/climatechange/aluminum.htm, Jan. 10, 2002; and Anonymous, *New materials improve energy efficiency and reduce electricity use in aluminum production*, http://es.epa.gov/techinfo/facts/nu-matrl.html, September 1992.

Efforts to improve the efficiency and operating characteristics of conventional Hall-Héroult electrolysis cells have included insulation of the cell, facing the cathode with a material that permitted cell operation with a lower inventory of molten aluminum (U.S. Pat. No. 4,650,552), providing a ceramic oxide coating for the anode (U.S. Pat. No. 4,173,518), designing cells with certain electrode configurations (U.S. Pat. Nos. 5,286,353, 5,006,209 and 4,865,701), compounding electrolytes that permit cell operation at different temperatures than normally used (U.S. Pat. Nos. 3,951,763 and 4,592,812), providing a highly agitated alumina feed area that is remote from the electrodes (U.S. Pat. No. 5,938,914), using cells having anodes with greatly increased surface area to permit lower temperature operation (U.S. Pat. No. 5,725,744), cooling the sidewalls of the cell to form a solid, protective layer (U.S. Pat. No. 4,608,135), or providing the cell with an inert liner (U.S. Pat. Nos. 4,608,134 and 4,608,135), and providing a cell in which the anode compartment and the cathode compartment are separated by a porous membrane (U.S. Pat. No. 4,338,177)

Efforts have also been made to improve the energy efficiency of the process by designing cells for enhanced heat recovery capabilities (U.S. Pat. No. 4,749,463), and by pre-heating alumina with heat recovered from the electrolysis cells (U.S. Pat. No. 4,451,337).

Other development efforts have focused on the provision of alternatives to the Hall-Héroult process. For example, U.S. Pat. No. 2,974,032 describes the reaction of alumina with carbon in an electric arc to produce aluminum and aluminum carbide, and different carbothermic processes are described in U.S. Pat. Nos. 3,971,653, 4,299,619 and 4,099,959. Other alternative processes are described in U.S. Pat. No. 5,505,823 (smelting aluminum from a potassium/aluminum sulfate mixture), in U.S. Pat. No. 4,445,934 (manufacturing aluminum by using a blast furnace), in U.S. Pat. No. 5,159,928 (smelting from a bath of aluminum chloride and using a tungsten plate or silicon carbide plate as the anode), in U.S. Pat. No. 4,324,585 (production of aluminum bromide and its subsequent electrolysis), and in U.S. Pat. No. 5,332,421 (smelting aluminum ore, such as nepheline syenite, with borax, sodium bicarbonate and a copper compound)

The Hall-Héroult electrolytic cell presently in commercial use carries out two distinct functions, the first is the mixing and melting of the components of the electrolytic bath, largely composed of cryolite, and the dissolution of alumina into the molten electrolyte. The second function of the cell is the electrolytic splitting of alumina into aluminum and oxygen. It is believed that present cell design is based on a compromise between the parameters that are important for each of these two different operations, and the cell is not optimized for either.

Separation of the operation of intermixing alumina with molten electrolyte from the electrolysis operation has been proposed in U.S. Pat. Nos. 3,501,387 and 3,616,439 to Love, which describes a charging cell that receives and intermixes alumina with molten electrolyte. The electrolyte with dissolved alumina is then circulated to a series of electrolysis cells where electrolysis is carried out. Molten electrolyte, depleted of alumina, is then recirculated back to the charging cell. In U.S. Pat. No. 4,681,671 to Duruz, an apparatus is described which recirculates molten electrolyte between an enrichment zone—in which fresh alumina is added—and an electrolytic cell having relatively large anode area, which is operated at a lower temperature than a normal Hall-Héroult process cell.

Modern Hall-Héroult cells are large and expensive to construct, resulting in financial charges amounting to more than the cost of alumina and power combined. The cells are operated in a series, or "potline", of up to 130 cells. Such large operations are designed to operate under steady conditions and their efficiency suffers when a cell must be shut down for service, or if anode positions are not carefully monitored and controlled. Such installations are also not amenable to easy or efficient turn-down (operation at less than full capacity), and are very difficult to move from one location to another.

Despite the resources that have been devoted to the improvement of the aluminum production process, significant opportunity remains to decrease the operating and capital cost requirements of the equipment that is used for aluminum smelting. Furthermore, it would be useful to provide an apparatus and process for aluminum smelting that had a higher energy efficiency than the present process. It would be even more useful if such a process required a lower capital cost per unit of capacity. It would also be useful if such a process provided flexible scale-up and turn-down capabilities, and improved portability.

SUMMARY OF THE INVENTION

Briefly, therefore the present invention is directed to a novel aluminum smelting apparatus comprising a melting furnace and an electrolytic cell, where the melting furnace and the electrolytic cell are each separate from the other and free of permanent interconnection.

The present invention is also directed to a novel method of smelting aluminum, the method comprising:

a. intermixing cryolite with alumina in a melting furnace;

b. heating the alumina and cryolite mixture to a temperature that is higher than the melting point of cryolite and mixing the cryolite and alumina until the alumina dissolves in molten cryolite;

c. transferring the molten cryolite and dissolved alumina from the melting furnace to an electrolytic cell comprising a vessel which is separate from the melting furnace and which is free of permanent interconnection therewith; and d. passing sufficient electrical current through the molten cryolite and dissolved alumina to cause the alumina to separate into aluminum metal and oxygen.

Among the several advantages found to be achieved by the present invention, therefore, may be noted the provision of an apparatus and process for aluminum smelting that have a higher energy efficiency than present processes, and also the provision of such a process that requires a lower capital cost per unit of capacity, and also the provision of such a process that provides flexible scale-up and turn-down capabilities, and improved portability.

BRIEF DESCRIPTION OF THE DRAWINGS

Corresponding reference characters indicate corresponding part thought the several views of the drawings.

DETAILED DESCRIPTION OF THE PREFERRED EMBODIMENTS

Figure 1:
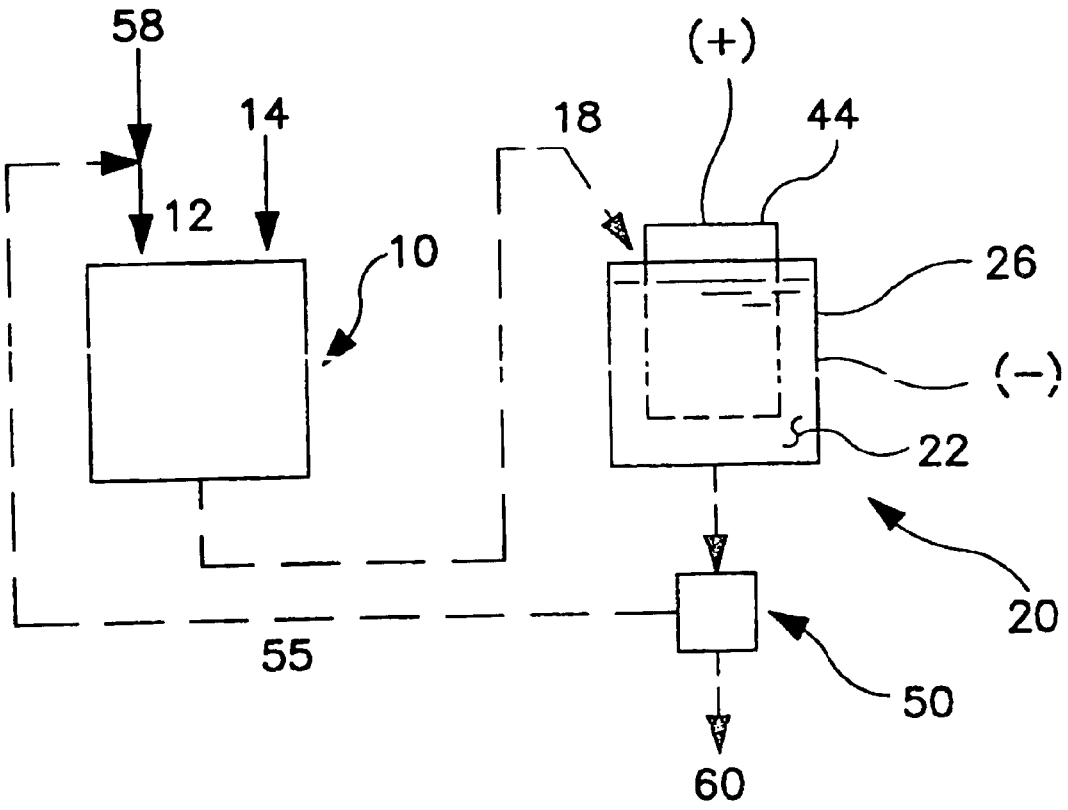
FIG. 1 illustrates an embodiment of the present aluminum smelting apparatus having a separate melting furnace and electrolytic cell which are free of permanent interconnection.

In accordance with the present invention, it has been discovered that an apparatus for smelting aluminum can be provided that includes a melting furnace and an electrolytic cell. An apparatus embodying the present invention is shown in FIG. 1. A preferred feature of the present apparatus is that the melting furnace (10) and the electrolytic cell (20) are each separate from the other and free of permanent interconnection. This arrangement is in contrast to the normal Hall Héroult cell unitary design, in which both operations of melting/mixing and electrolysis are carried out in the same, single cell, and is also in contrast to the apparatus described in U.S. Pat. Nos. 3,501,387, 3,616,439, and 4,681,671, each of which shows smelting apparatus having separate, but permanently interconnected melting/mixing and electrolysis vessels.

The feature of providing separate units for melting/mixing and electrolysis gives the present invention an advantage of permitting the device that is employed for each of the separate operations to be designed and optimized for its specific duty without regard for the requirements necessary to accommodate the other operation. For example, the melting furnace can be designed and optimized for intermixing and heating alumina with cryolite electrolyte materials, without regard for electrolysis, gas venting, or aluminum recovery requirements. And the electrolysis cell of the present invention can be designed for construction at a reduced capital cost and optimized for electrolysis of alumina from a bath of molten cryolite that is saturated with dissolved alumina, without regard for intermixing and heating.

When the terms "smelting operation" are used herein, they are meant to include the steps of heating and melting electrolyte, intermixing and dissolving alumina in the electrolyte, and passing electric current through the electrolyte/alumina to cause electrolytic splitting of alumina into aluminum metal and oxygen.

Figure 2A:
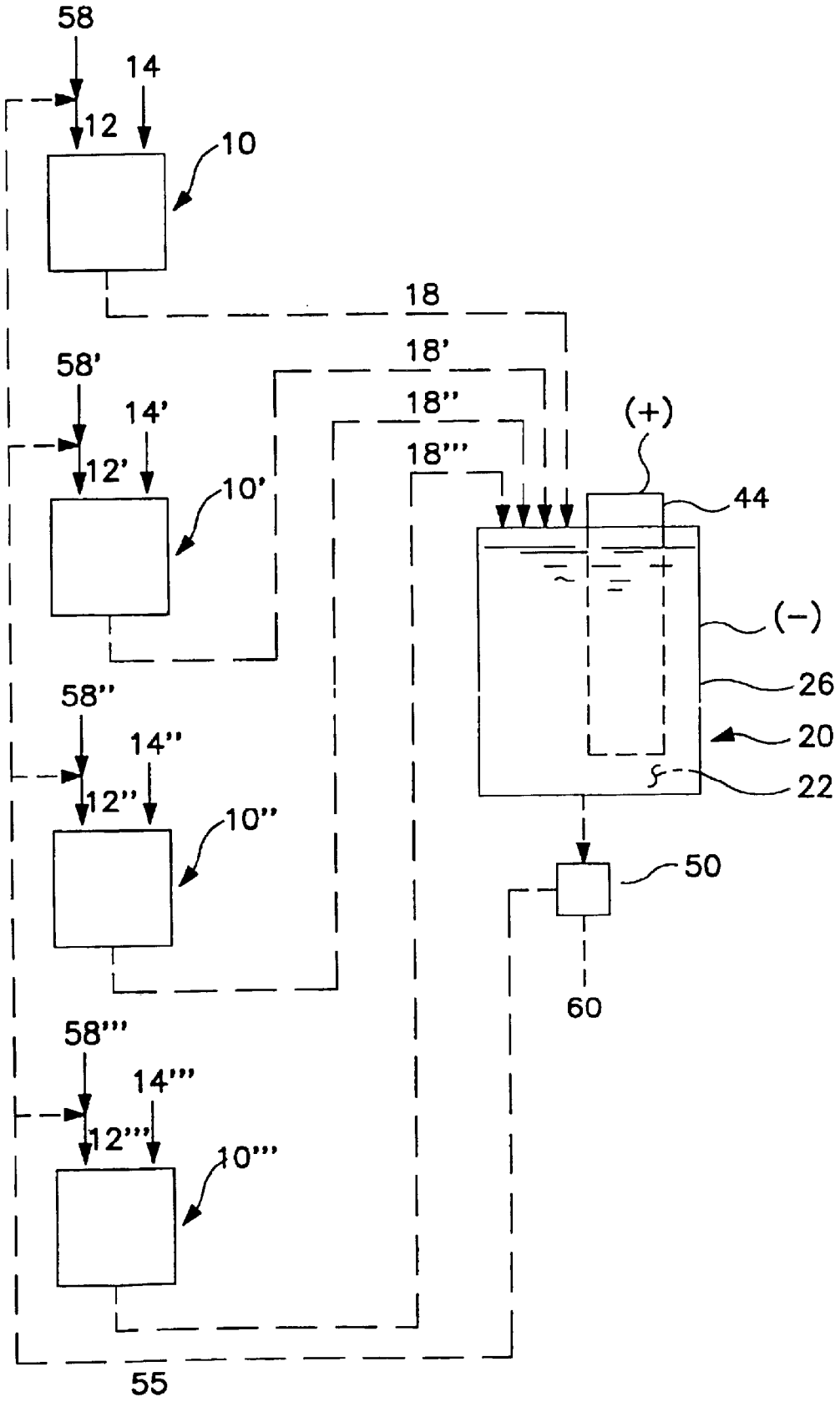
FIG. 2 shows embodiments of the present smelting apparatus having (a) multiple melting furnaces that service one electrolytic cell, and (b) one melting furnace that services multiple electrolytic cells.
Figure 2B:
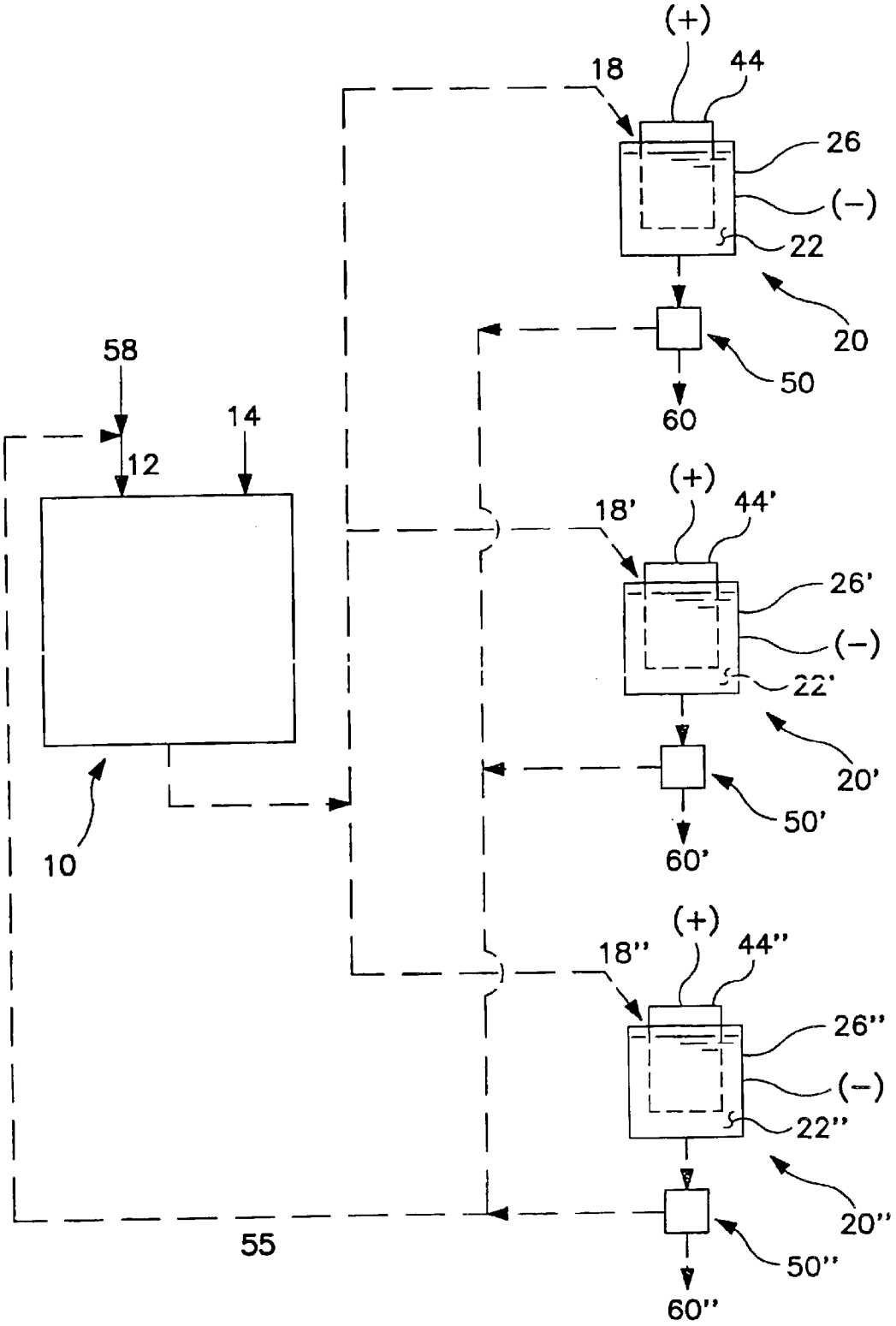
Figure 3:
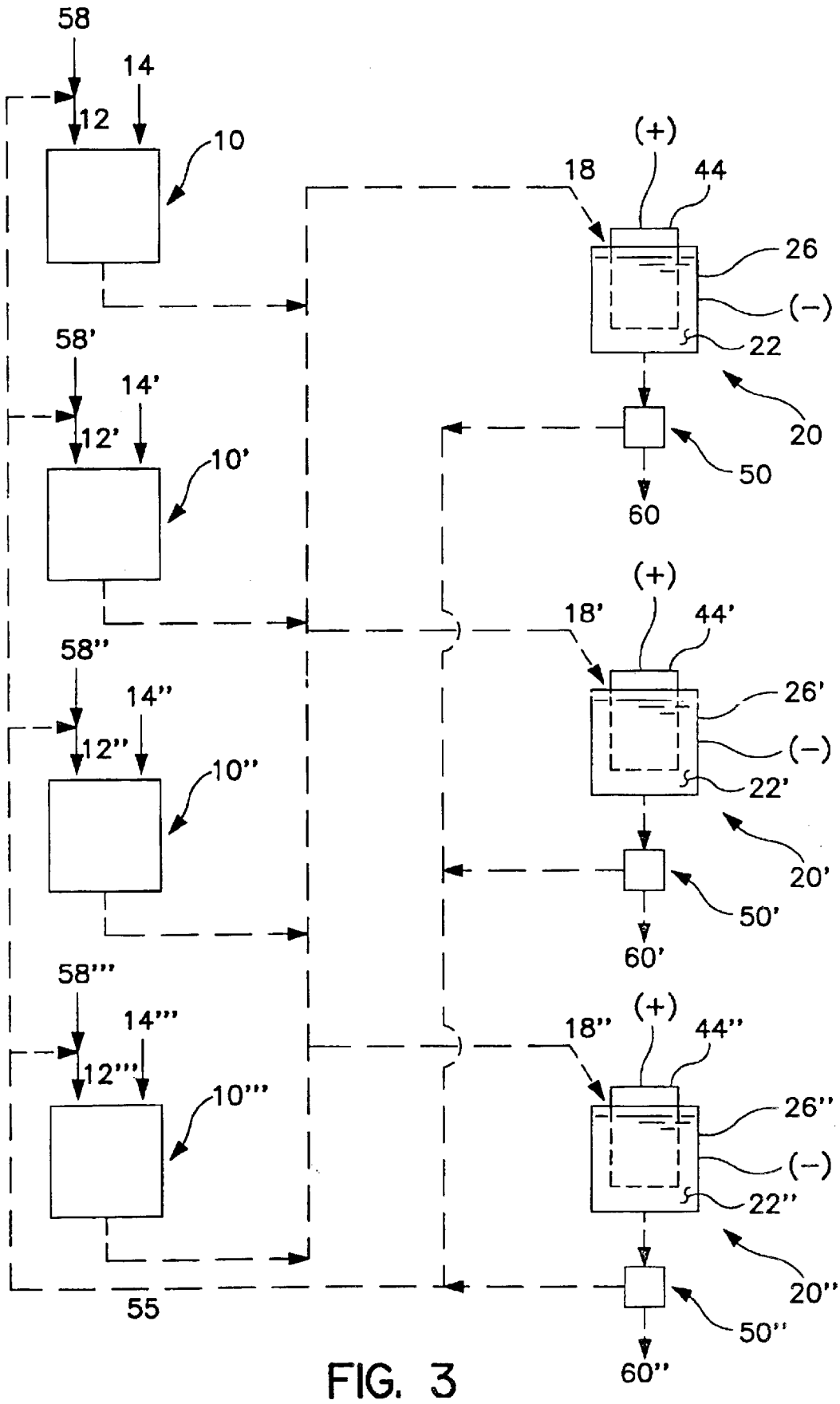
FIG. 3 shows an embodiment of the present smelting apparatus that has multiple melting furnaces that service multiple electrolytic cells.

Furthermore, the present feature where the two separate units are not permanently interconnected provides the advantage of improved portability for the apparatus, and also the increased flexibility of using two or more furnaces to service one electrolysis cell (as illustrated in FIG. 2(*a*)), or the use of one furnace to service two or more different electrolysis cells (as illustrated in FIG. 2(*b*)). In addition, as illustrated in FIG. 3, two or more melting furnaces (10, 10', 10", 10''', and etc.) can be used in conjunction with two or more electrolysis cells (20, 20', 20", and etc.) to provide a production plant that can easily be scaled up by adding incremental units, and which has very flexible turn-down capability by simply taking incremental units of furnaces or cells, or both, temporarily off line as required.

The melting furnace of the present invention can be any type of furnace that can be used to melt cryolite and dissolve alumina at a temperature of up to about 1000° C. The melting furnace can be a gas-fired crucible furnace, a reverberatory furnace, or an electric induction furnace. It is preferred that the melting furnace of the present invention is an induction melting furnace that is capable of heating cryolite to a temperature of over about 960° C. When it is said that the melting furnace is an induction furnace, what is meant is an electric furnace in which materials are heated by electrical induction, and in particular, the process of heating electrically conductive materials by inducing high-frequency currents within the material. It is more preferred that the melting furnace is one that is portable. When it is said that a melting furnace is portable, it is meant that the furnace can be moved from one location to another without substantial dismantling of the furnace, and that after having been moved, the furnace can be re-connected and be ready for use within, at most, several hours. It is preferred that the melting furnace is one that is transportable by forklift truck.

Examples of the type of induction melting furnaces that can be used in the present invention are those manufactured by Inductotherm, Ltd. and shown on their website at http://www.inductothermindia.com/, (Mar. 20, 2002). Preferred types of induction furnace include the mini heel furnace, the steel shell furnace, and the small steel shell furnace, made by Inductotherm, Ltd.

When any electric induction melting furnace is used in the present invention, it is to be understood that it is to be installed with a power supply, a control system, a safety system, and any and all other ancillary equipment that is common and well known to one of skill in the electric induction furnace industry.

In the apparatus of the present invention, as shown in FIG. 1, molten electrolyte, which can be a cryolite-based electrolyte, containing dissolved alumina is transferred from the melting furnace (10) to an electrolytic cell (20), which is separate from the furnace and is free of permanent interconnection with the furnace.

When it is said that the melting furnace and the electrolysis cell are "separate", it is meant that two different units are employed in the smelting operation, rather than for only one unit to be used for both the heating/melting and the electrolysis operations.

When it is said that the melting furnace and the electrolysis cells of the present smelting apparatus are free from permanent interconnection, what is meant is that the units are not connected to each other by piping or other conduits through which process fluids pass continuously during the smelting operation. It is preferred that the melting furnace and the electrolytic cell are not interconnected by piping or other conduits that prevent movement of one or more of the units during the smelting operation. In one preferred embodiment, a pipe or other conduit, is temporarily used to interconnect the melting furnace with the electrolytic cell in order to transfer molten electrolyte/alumina mixture from the furnace to the electrolytic cell, and such pipe or other conduit is disconnected after the transfer is accomplished. The same type of connection can be made at the end of the electrolysis cycle in order to transfer the depleted electrolyte back to the furnace. In another preferred embodiment, the melting furnace and the electrolytic cell are not interconnected at any time.

Electrolytic cells that are capable of electrolytically splitting alumina are well known in the art, and any electrolytic cell that is capable of carrying out the function of passing an electric current through a molten electrolyte/alumina bath at a temperature of about 960° C. sufficient to electrolytically split alumina into aluminum metal and oxygen can be used. Even existing (used) electrolytic cells can be employed in the present invention if used for electrolysis only. Examples of electrolytic cells that are suitable for use in the present invention are described in U.S. Pat. Nos. 2,974,032, 4,608,134, and 4,608,135.

It is preferred that the present electrolytic cell is one that is designed to operate most efficiently in the electrolysis of alumina without regard to any requirement for accepting, intermixing, melting, or dissolving fresh alumina or of heating the bath contents.

The electrolytic cell of the present invention is preferably a vessel capable of containing a bath that includes a mixture of molten cryolite and alumina. The cell includes at least two electrodes, at least one of which is a cathode and at least one of which is an anode. The electrodes are located at least partly in contact with the mixture of molten cryolite and alumina. In some embodiments, the electrodes are at least partly submerged into the mixture of molten cryolite and alumina.

Figure 4A:
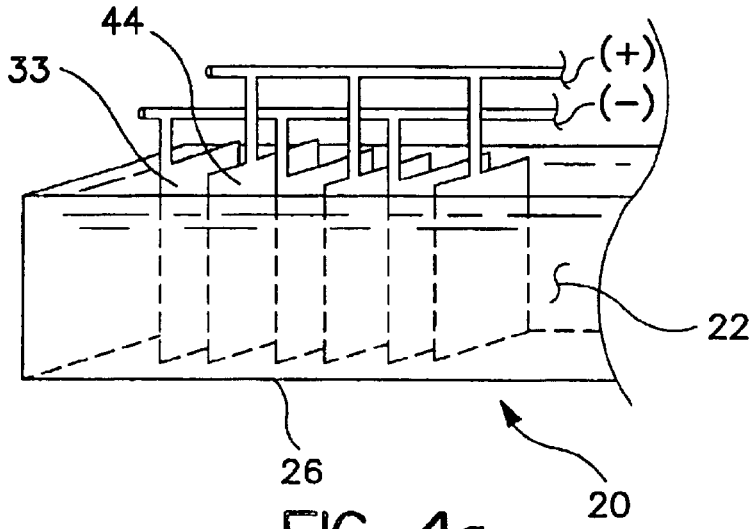
FIG. 4 shows schematic views which illustrate alternative embodiments for the design of the electrolytic cell of the present invention, where (a) shows alternating anodes and cathodes that are arranged as spaced apart flat plates and suspended into a molten electrolyte/alumina bath inside a vessel; (b) shows the anode and cathode as being a pipe or hollow cylinder inside of which is a rod, where both the rod and the cylinder have the same longitudinal axis so that the annular space between them can be filled with molten electrolyte/alumina and thereby form the gap in which electrolysis takes place; and (c) shows a bath of molten electrolyte/alumina as a long, narrow tank into which anodes in the form of flat plates are suspended.
Figure 4B:
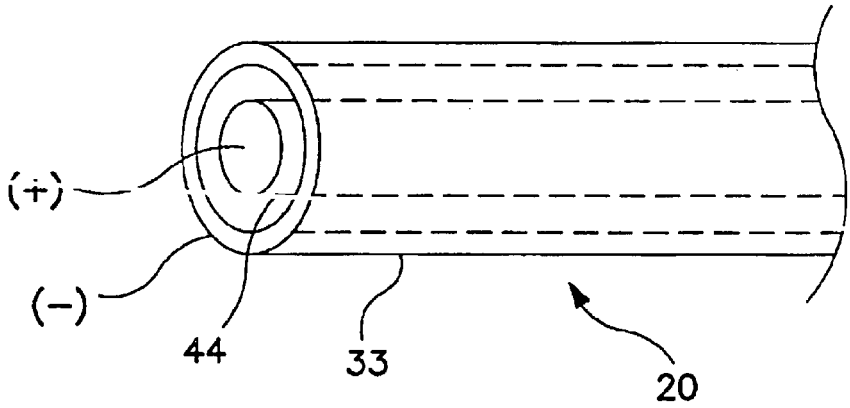
Figure 4C:
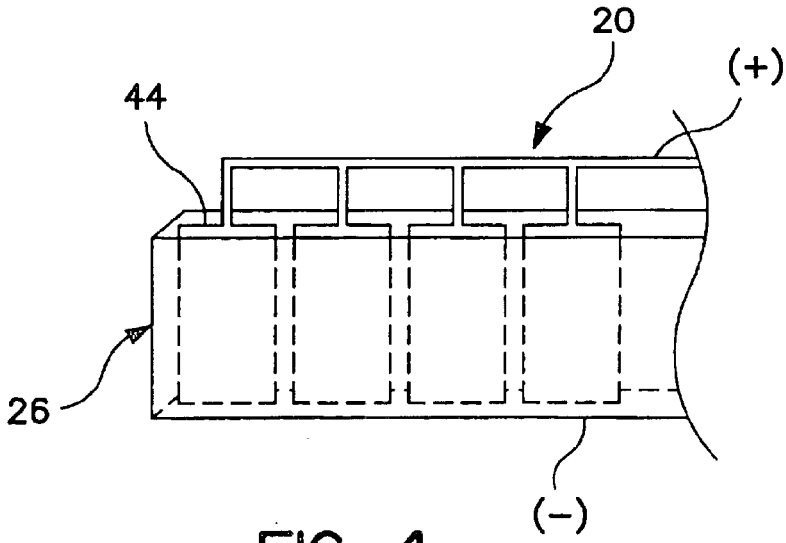

In a preferred embodiment of the present invention, as shown in FIG. 4(*a*), the electrolytic cell (20) includes a vessel (26) to hold a molten electrolyte/alumina bath (22) into which are suspended spaced apart electrodes that are alternately connected to positive and negative electrical contacts in order that they can function as anodes (44) and cathodes (33). Both anodes and cathodes are composed of plates of carbon that can be suspended from busbars of positive and negative charge. When the electrodes are described as being "spaced apart", it is meant that they are arranged adjacent to each other like a deck of cards, for example, but having a space between each electrode and the next one. By way of example, the electrodes can be carbon plates of approximately 2" in thickness and as much as several feet in width and length. The gap between the new electrodes can be set to about 2", for example. Due to this design, the gap between an anode and a cathode cannot become more than about 3" during the erosion of the anode. Therefore, an advantage of this design is that the gap between the anodes and cathodes is maintained at about the same distance throughout the electrolysis cycle, regardless of the degree of erosion of the anodes. Also, the vessel (26) can be constructed from a material such as carbon coated steel sheet, rather than from monolithic carbon block, and at a lower capital cost.

In another preferred embodiment, the electrolytic cell of the present smelting apparatus is constructed, as shown in FIG. 4(*b*), of an anode (44) in the form of a cylindrical carbon rod, which is positioned within a cathode (33) that is in the form of a pipe, or hollow cylinder, also formed from carbon. The molten electrolyte/alumina (18) is fed into the annular space between the anode (44) and cathode (33), and electrolysis takes place in the gap between the two electrodes. As an alternative, the selection of the two electrodes as anode and cathode can be reversed.

In another preferred embodiment, the electrolytic cell of the present invention is constructed, as shown in FIG. 4(*c*), of a narrow vessel (26), which is relatively long and deep. Anodes, formed of flat carbon plates (44) are suspended into a molten electrolyte/alumina bath (22) from a busbar. The walls of the vessel (26) act as the cathode of the cell. In a preferred embodiment, the vessel is constructed at least partly from carbon coated steel sheet. By way of example, the anodes can be carbon plates of approximately 2" in thickness and as much as several feet in width and length. The vessel can be relatively narrow, about 6" in inside dimension for example, in order to provide a 2" gap between a new anode and the wall of the cell, which acts as the cathode. As the anode erodes during electrolysis, the gap between the anode and the cathode can never exceed 3", due to the design of the cell. Accordingly, electrolytic efficiency is maintained without any adjustment by the operator.

In a preferred embodiment, the present electrolytic cell contains at least two anodes which are moveable within the mixture of molten cryolite and alumina while current is flowing between the cathode and at least one of the at least two anodes. By being moveable within the molten mixture of the electrolyte/alumina, it is believed that the anodes of the present electrolytic cell can provide sufficient mixing action to the bath to promote mass transfer, and also to free the anode of a gas coating so as to reduce anode blinding.

Figure 5A:
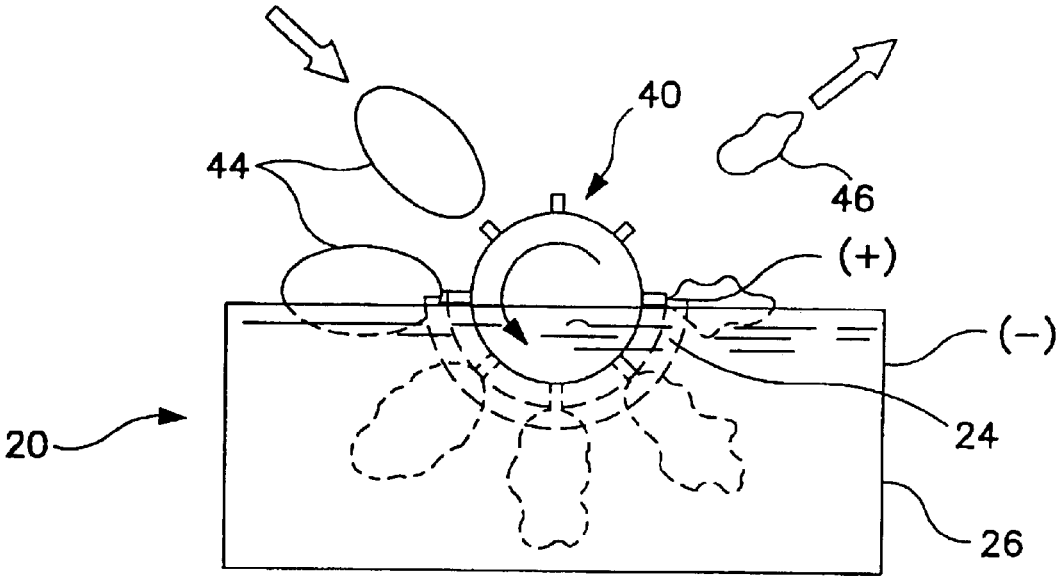
FIG. 5 shows alternative embodiments for the electrolytic cell, where (a) shows an embodiment of an electrolytic cell of the present invention having anodes removeably affixed to a rotatable hub so that the anodes can be moved through a molten electrolyte/alumina bath during electrolysis and subsequently replaced with new anodes without shutting down the operation of the cell; and (b) illustrates an embodiment of an electrolytic cell of the present invention having anodes removeable affixed to a movable conveyor in a manner so that the anodes can be moved through a molten electrolyte/alumina bath during electrolysis and subsequently replaced with new anodes without shutting down the operation of the cell.
Figure 5B:
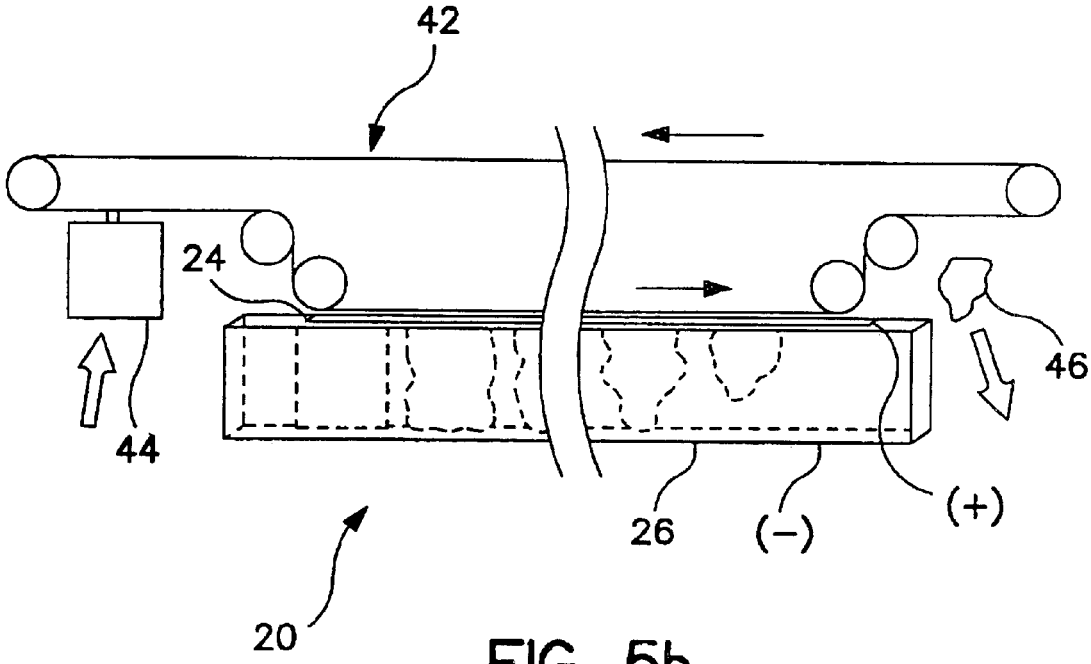

Preferred embodiments of the present electrolytic cell are shown in FIG. 5(*a*) and FIG. 5(*b*). In FIG. 5(*a*), multiple anodes (44), at least one of which is removable from the mixture of molten cryolite and alumina for replacement while the cell is in operation, are removeably affixed to a rotatable hub (40), which is capable of rotation to pass the anodes through the electrolytic bath (22). As each electrode enters the bath, it engages a current transfer contact (24), which transfers electrical current to the anode during the time that the anode is submerged in the bath. Current flows from the anodes (44) in the bath, through the molten electrolyte (22), and to the wall of the electrolysis cell (26), which acts as the cathode.

In preferred embodiments, (illustrated in FIG. 5(*a*) and FIG. 5(*b*)) the electrolysis vessel is a narrow, deep tank, in which the vessel wall—which acts as a cathode—is spaced closely to the anodes, which are moving through the bath. An advantage of this design is that the gap between the anode and cathode remains reasonably unchanged, even as the anode is consumed during electrolysis. This provides relatively constant current flow in all parts of the cell, even as the anodes erode away.

In another preferred embodiment, as shown in FIG. 5(*b*), the anodes (44) are removeably affixed to a conveyor (42) that is capable of movement causing the anodes to enter and pass through the molten electrolytic bath (22). As each anode enters the bath, it electrically engages a current transfer contact (24), which feeds electric current to the anode during the time that the anode is submerged in the bath.

It is an advantageous feature of the electrolytic cells shown in FIG. 5(*a*) and FIG. 5(*b*), and embodied in the general inventive concept described herein, that the anodes (44), which erode away as they pass through the electrolyte/alumina bath (22), can be removed from the bath when they are significantly eroded (46), and replaced with new anodes (44), which can then re-enter the bath.

As discussed above, in a preferred embodiment, the present apparatus can have two or more melting furnaces. In another preferred embodiment, the present apparatus can have two or more electrolytic cells. In another preferred embodiment, the present apparatus can have two or more melting furnaces and two or more electrolytic cells.

Each melting furnace of the present invention has a particular capacity, which is often expressed in terms of the amount of molten electrolyte, saturated with alumina, that the furnace can produce at a desired temperature (often about 960° C.) in a given time. For example, this could be expressed as tons of saturated and heated melt per hour.

In like manner, each electrolytic cell of the present invention has a particular capacity, as well. The capacity of the electrolytic cell can be expressed in terms of the amount of saturated and heated melt that the cell can process to substantial depletion of alumina in a given time. For example, this also could be expressed as tons of saturated and heated melt per hour.

In a preferred embodiment of the present apparatus, the furnace, or furnaces, if there are more than one furnace, have substantially the same capacity as the cell, or cells, if there are more than one cell. In other words, the furnace capacity is matched with the cell capacity.

Because the melting furnaces are significantly different from the electrolytic cells in design, intricacy, and materials of construction, it is to be expected that the capital cost of a furnace having a certain capacity, for example, may be significantly different from the capital cost of an electrolytic cell having the same capacity. Moreover, the capital cost-per-unit capacity curve for a furnace may be significantly different from that for an electrolytic cell. In other words, it may be more economical to purchase one, large furnace to serve two or more smaller electrolytic cells, or vice-versa. With the present invention, this can easily be done, and the flexibility provided by the present, novel, design provides the advantage of being able to minimize total cost of the smelting apparatus by simultaneously optimizing the costs/capacities of the furnaces and the electrolytic cells.

In a preferred embodiment, the number of melting furnaces and the capacity of each melting furnace to intermix, heat and dissolve alumina into cryolite electrolyte, and the number of electrolytic cells and the capacity of each electrolytic cell to electrolytically free aluminum from the dissolved alumina are selected so that the total capacity of the melting furnaces is equal to the total capacity of the electrolytic cells.

In another preferred embodiment, the number and capacity of melting furnaces and the number and capacity of electrolytic cells are selected to minimize the total capital cost of the apparatus.

The present invention provides a novel process for the smelting of aluminum. This process can be described by reference to FIG. 1, for example. The present method involves intermixing a stream containing cryolite electrolyte materials (12) (which may be termed "cryolite", herein) with alumina (14) in a melting furnace (10). The cryolite can be composed of fresh, molten or solid cryolite (58), or it can be material that has been depleted of alumina in an electrolytic cell and re-cycled (55) to the furnace. It is preferred that the amount of alumina that is added to the cryolite is sufficient to provide a saturated solution of alumina in cryolite. At the temperatures that are normally encountered during electrolysis (900° C. to about 1000° C.), this amount is about 6% by weight alumina in cryolite.

In the furnace, the alumina and cryolite mixture is heated to a temperature that is higher than the melting point of cryolite and mixing the cryolite and alumina until the alumina dissolves in molten cryolite. When it is said that the alumina dissolves in the cryolite, it is meant to include alumina present in the cryolite in true molecular solution, but also to include alumina present in the form of a dispersion, emulsion, or micro-emulsion, as well. When the alumina is dissolved in the cryolite, the molten cryolite and dissolved alumina (18) is transferred from the melting furnace (10) to an electrolytic cell (20) comprising a vessel which is separate from the melting furnace and which is free of permanent interconnection with the furnace. When the molten cryolite/alumina has been transferred to the electrolytic cell, electrical current is passed through the molten cryolite and dissolved alumina (22) to cause the alumina to separate into aluminum metal and oxygen.

If desirable, the spent cryolite and aluminum can be removed from the cell (20) and passed through a separator (50), in which aluminum metal (60) is separated from the molten cryolite (55), which is depleted of alumina. Alternatively, the aluminum metal can simply be drained or decanted directly from the electrolytic cell, and the spent cryolite can be transferred back to the melting furnace.

In those embodiments of the present invention where multiple melting furnaces and multiple electrolytic cells are employed, a preferred method is to match the capacity of the smelting apparatus to the demand for aluminum production by operating only the number of melting furnaces and the number of electrolytic cells sufficient to provide a total capacity that meets the demand. As demand changes, other combinations of furnaces and cells can be started up, or turned off, to match the changed demand. Thus, it is an advantage of the present invention that it is rapid and easy to scale-up production or to turn-down the capacity of the apparatus to meet any changes in demand, by simply starting up or turning off the correct number and type of units.

Another advantage of those embodiments of the present invention in which the electrolytic cell has multiple, removable anodes, is that the electrolytic cell can be operated under steady and continuous conditions while the anodes, which are eroded during electrolysis, are replaced. This permits cell operation to continue without the time-consuming and costly interruption that is normally required for the change of an anode.

All references cited in this specification, including without limitation all papers, publications, patents, patent applications, presentations, texts, reports, manuscripts, brochures, books, internet postings, journal articles, periodicals, and the like, are hereby incorporated by reference into this specification in their entireties. The discussion of the references herein is intended merely to summarize the assertions made by their authors and no admission is made that any reference constitutes prior art. Applicants reserve the right to challenge the accuracy and pertinency of the cited references.

In view of the above, it will be seen that the several advantages of the invention are achieved and other advantageous results obtained.

As various changes could be made in the above methods and compositions without departing from the scope of the invention, it is intended that all matter contained in the above description and shown in the accompanying drawings shall be interpreted as illustrative and not in a limiting sense.

What is claimed is:

1. A method of smelting aluminum, the method comprising:

a. intermixing cryolite with alumina in a melting furnace;

b. heating the alumina and cryolite mixture to a temperature that is higher than the melting point of cryolite and mixing the cryolite and alumina until the alumina dissolves in molten cryolite;

c. transferring the molten cryolite and dissolved alumina from the melting furnace to an electrolytic cell in a discontinuous manner;

d. passing sufficient electrical current through the molten cryolite and dissolved alumina to cause the alumina to separate into aluminum metal and oxygen;

e. removing the molten cryolite and aluminum metal from the electrolytic cell and separating the aluminum metal from the molten cryolite; and f. returning the molten cryolite from which aluminum has been separated directly to the melting furnace.

2. The method according to claim 1, wherein the amount of alumina which is intermixed with cryolite in step a is sufficient to saturate the cryolite.

3. The method according to claim 1, wherein the melting furnace comprises two or more melting furnaces and wherein the electrolytic cell comprises two or more electrolytic cells, and where the amount of aluminum produced is subject to a demand, the additional step of responding to a change in the demand by starting up or turning off the number of melting furnaces and electrolytic cells so that the amount of aluminum that is produced matches the demand.

4. The method according to claim 1, wherein the electrolytic cell has multiple, removable anodes, comprising the step of replacing at least one anode during cell operation.

5. The method according to claim 1, wherein the melting furnace comprises an induction melting furnace that is capable of heating cryolite to a temperature of over about 900° C.

6. A method of smelting aluminum, the method comprising:

a. intermixing cryolite with alumina in a melting furnace;

b. heating the alumina and cryolite mixture to a temperature that is higher than the melting point of cryolite and mixing the cryolite and alumina until the alumina dissolves in molten cryolite;

c. transferring the molten cryolite and dissolved alumina from the melting furnace to an electrolytic cell in a discontinuous manner;

d. passing sufficient electrical current through the molten cryolite and dissolved alumina to cause the alumina to separate into aluminum metal and oxygen without adding additional molten cryolite and alumina to the electrolytic cell;

e. separating the aluminum metal from the molten cryolite; and f. returning the molten cryolite from which aluminum has been separated to the melting furnace.

* * * * *